United States Patent [19]

Gremillion

[11] Patent Number: 4,785,309

[45] Date of Patent: Nov. 15, 1988

[54] EXTENDABLE ANTENNA MAST WITH INDEPENDENT RETRACTING AND LIFTING CABLES

[76] Inventor: Ernest J. Gremillion, Post Office Box 556, Larose, La. 70373

[21] Appl. No.: 862,303

[22] Filed: May 12, 1986

[51] Int. Cl.[4] ..... H01Q 1/10

[52] U.S. Cl. ..... 343/883; 343/889; 343/901; 343/905

[58] Field of Search ..... 343/883, 889, 901, 905

[56] References Cited

U.S. PATENT DOCUMENTS

| | | | |
|---|---|---|---|
| 133,017 | 11/1872 | Davis | 52/121 |
| 2,384,279 | 9/1945 | Calhoun | 52/121 |
| 2,675,211 | 4/1954 | Regoord | 254/387 |
| 2,795,303 | 6/1957 | Muelhause | 198/456 |
| 3,248,831 | 5/1966 | Jones | 52/121 |
| 3,500,429 | 3/1970 | Majkrzak et al. | 343/883 |
| 3,638,806 | 2/1972 | Hippach | 212/55 |
| 4,151,534 | 4/1979 | Bond | 343/883 |
| 4,176,360 | 11/1979 | Leavy et al. | 343/883 |
| 4,568,808 | 2/1986 | Thuvies et al. . | |

*Primary Examiner*—William L. Sikes
*Assistant Examiner*—Doris J. Johnson
*Attorney, Agent, or Firm*—Fleit, Jacobson, Cohn & Price

[57] ABSTRACT

A vertically extendible and retractable mast for supporting an antenna and coaxial cable connected thereto to receive and/or broadcast information and is particularly adapted for use by seismograph exploration crews for receiving data from portable transmitter units which may be located at substantial distances from the receiver with the mast being adapted for mounting stationarily or on a mobile vehicle. The mast and antenna is a multiple stage antenna with simultaneous movement of the sections of the mast with the coaxial cable being fed at the same rate that the upper end of the antenna mast moves with the specific arrangement of the extension or lifting cables, retracting cables, winch and coaxial cable producing a novel and unique extendible and retractable antenna mast.

6 Claims, 2 Drawing Sheets

EXTENDABLE ANTENNA MAST WITH INDEPENDENT RETRACTING AND LIFTING CABLES

BACKGROUND OF THE INVENTION

1. Field of the Invention

The present invention generally relates to a vertically extendible and retractable mast for supporting an antenna and coaxial cable connected thereto to receive and/or broadcast information and is particularly adapted for use by seismograph exploration crews for receiving data from portable transmitter units which may be located at substantial distances from the receiver with the mast being adapted for mounting stationarily or on a mobile vehicle. The mast and antenna is a multiple stage antenna with simultaneous movement of the sections of the mast with the coaxial cable being fed at the same rate that the upper end of the antenna mast moves with the specific arrangement of the extension or lifting cables, retracting cables, winch and coaxial cable producing a novel and unique extendible and retractable antenna mast.

2. Information Disclosure Statement

Antenna masts of various types have been used in broadcasting and receiving radio messages in many different environments. Included in such developments are antenna masts which can be extended vertically or retracted vertically so that they can be mounted on a vehicle and transported to a desired site. This type of antenna mast is quite useful in seismograph exploration since it enables an exploration crew to move the antenna to a desired exploration site and then extend the antenna so that it can receive signals from a plurality of portable seismograph units so that these signals may be received and used as an input into a computer system or the like in order to more quickly evaluate the geologic formation being explored. While extendible antenna masts are known in the prior art, none of them utilizes the same or equivalent arrangement of telescopic sections, extension or lifting cables, retracting cables, winch and coaxial cable as utilized in the present invention.

SUMMARY OF THE INVENTION

An object of the present invention is to provide an extendible and retractable antenna mast having a coaxial cable connected therewith for receiving and/or transmitting radio signals with the sections of the antenna being simultaneously moved during extension and retraction rather than being progressively moved.

Another object of the invention is to provide an antenna mast in accordance with the preceding object in which the antenna is provided with a retracting cable that will provide a positive retraction of the mast or tower during the retracting cycle thereby assuring positive movement of the sections of the antenna during both extension and retraction.

A further object of the invention is to provide an antenna mast in accordance with the preceding objects in which the coaxial cable is fed or retracted at the exact same rate of movement of the upper end of the antenna mast thereby assuring proper movement of the coaxial cable.

Still another object of the invention is to provide an extendible and retractable antenna mast having a unique arrangement of telescopic sections, lifting and retracting cables, anchors, winches and coaxial cable arrangement which provides movement of the sections of the mast and which is relatively simple in constructure, easy to extend and retract in a positive manner and which will provide a sturdy antenna mast or tower when extended.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
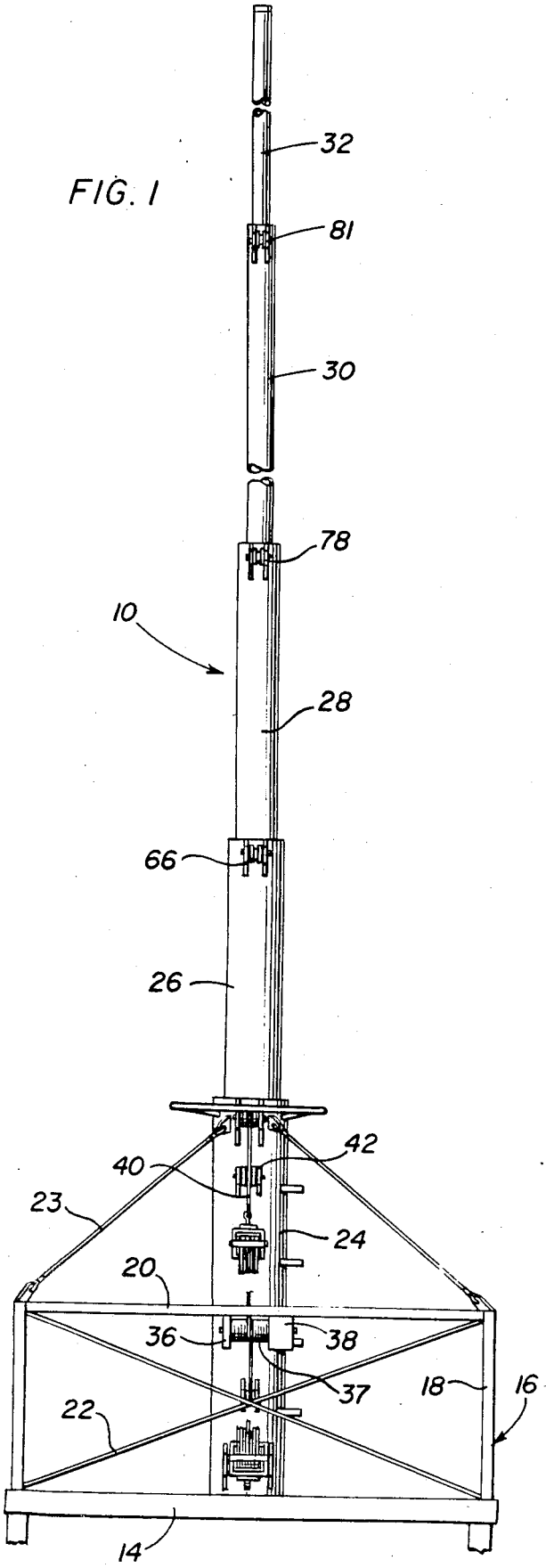
FIG. 1 is an elevational view of the extendible antenna mast of the present invention with portions broken away.

Referring now specifically to the drawings, the extendible and retractable antenna mast of the present invention is generally designated by reference numeral 10 and includes a base or supporting structure 14 that may be stationarily mounted or mounted on a mobile vehicle such as a truck chassis, swamp buggy or other vehicle capable of being driven to a remote seismograph exploration site. The supporting base 14 includes a frame 16 including uprights 18, horizontal top pieces 20 and diagonal braces 22 of conventional construction.

Figure 3:
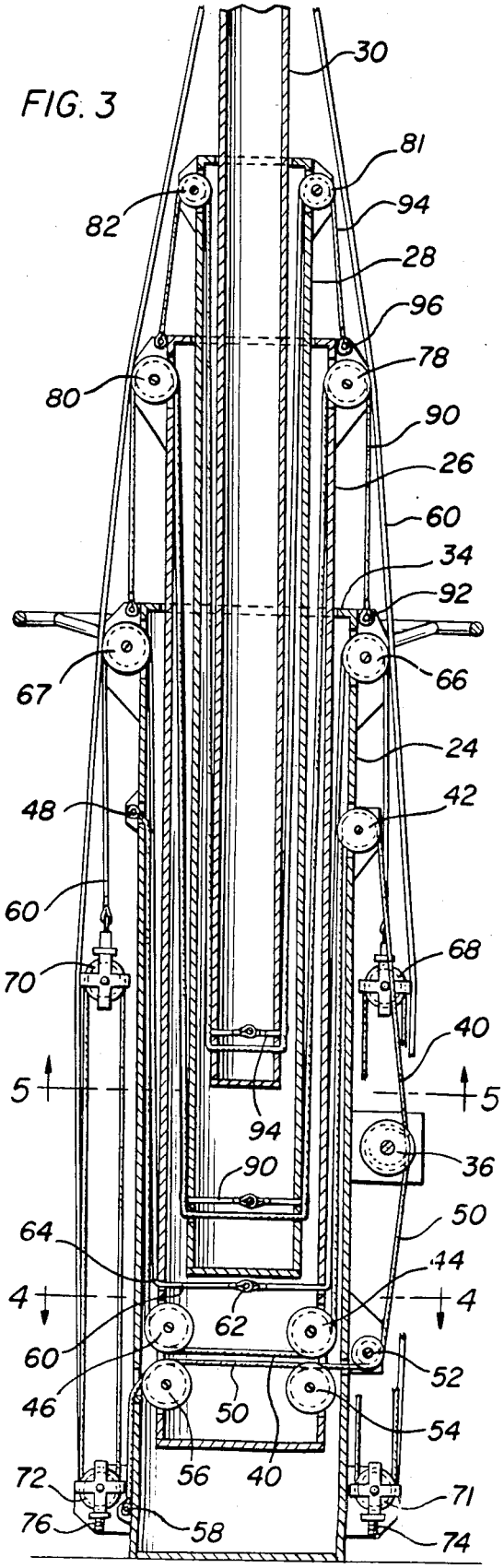
FIG. 3 is a vertical sectional view taken substantially upon a plane passing along section line 3—3 on FIG. 2 illustrating the structural details of the mast and the orientation of the components with respect thereto.
Figure 2:
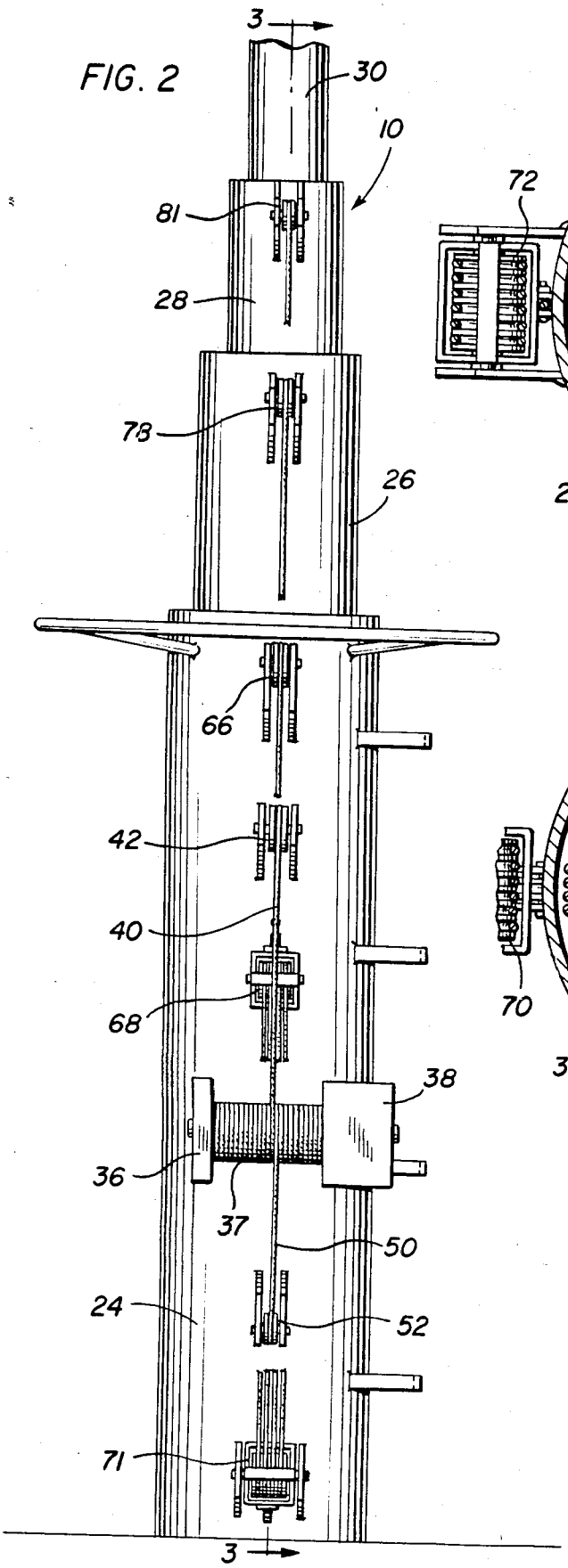
FIG. 2 is a side elevational view of the lower portions of the antenna mast.
Figure 4:
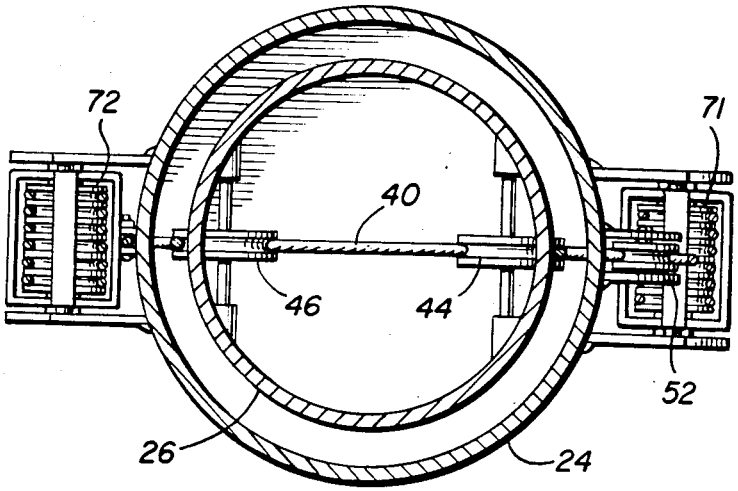
FIG. 4 is a transverse, sectional view taken substantially upon a plane passing along section line 4—4 on FIG. 3 illustrating further structural details of the invention.
Figure 5:
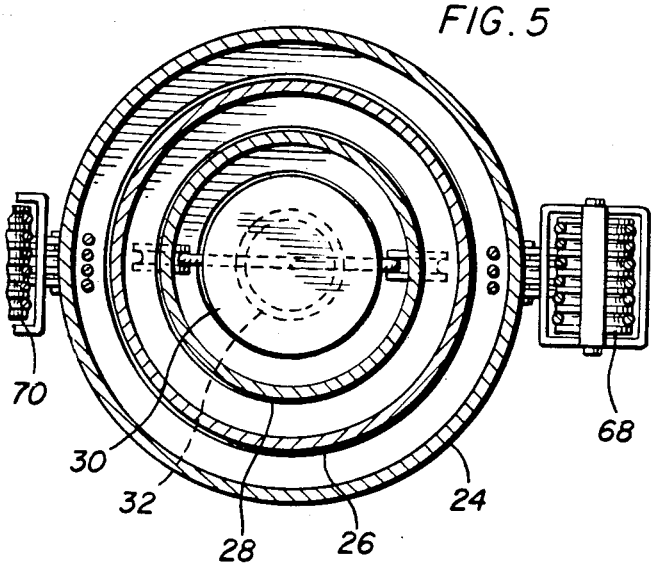
FIG. 5 is a transverse, sectional view taken substantially upon a plane passing along section line 5—5 on FIG. 3 illustrating further structural details of the invention.

The antenna mast 10 includes a lower tubular section 24 having its lower end connected with and supported from the base or platform 14 in a conventional and well known manner. A plurality of intermediate tubular sections 26, 28 and 30 are illustrated associated with the tubular section 24 with it being pointed out that any number of intermediate sections 26, 28 and 30 may be utilized. An upper tubular section 32 is provided at the upper end of the mast 10 with the tubular sections 24–32 being cylindrical in cross section or any other cross section if desired with the dimensions of the sections being such that the uppermost sections will telescope into the lowermost sections as illustrated in FIG. 3 with each of the sections including an inturned flange 34 at its upper end for closely receiving the next adjacent upper section. The lower tubular section 24 is stationary and includes a winch 36 mounted on the exterior thereof at an elevated position in relation to the lower end and also spaced downwardly from the upper end with a reversible motor 38 being provided for driving the drum 37 of winch 36 in either rotational directions. A lift cable 40 is wound on the winch drum 37 and extends upwardly and is entrained over a pulley 42 mounted on and projecting through the wall of the lower tubular section 24 as illustrated in FIG. 3. The cable 40 passes downwardly between the stationary lower tubular section 24 and the next adjacent intermediate tubular section 26 and extends under a pulley 44 journalled interiorly of the lower portion of the intermediate tubular section 26 with the periphery of the pulley 44 passing through the wall of the tubular section 26 so that the cable 40 can pass inwardly under the pulley 44. The cable 40 then passes diametrically of the lower portion of the tubular member 26 and under a pulley 46 mounted on the lower end of the tubular member 26 in diametric alignment with the pulley 44 with the outer periphery of the pulley 46 also extending through the diametric opposite portion of the wall of the tubular member 26 as compared with the pulley 44. The cable 40 then extends upwardly between the interior of the lower tubular section 24 and the intermediate tubular section 26 and is anchored to the lower tubular section 24 at anchor point 48 which is diametrically opposed and in alignment with the pulley 42. Thus, as the cable 40 is wound onto the drum 37 of the winch 36, the effective shortening of the length of the cable 40 will lift the intermediate section 26 upwardly in relation to the lower tubular section 24 to a maximum point where the pulleys 46 and 44 generally are in alignment with the anchor point 48 and the pulley 42.

The intermediate section 26 is also provided with a retraction cable 50 that is wound onto the drum 37 of the winch 36 in a direction so that when the cable 40 is wound onto the drum of the winch 36, the cable 50 will be unwound therefrom. The cable 50 extends downwardly and passes around the outer surface and bottom surface of a pulley 52 mounted externally of the lower tubular member 24 and passes inwardly through the wall thereof and engages a pulley 54 mounted on the lower end portion of the intermediate tubular section 26 generally in alignment with the pulley 44 with the periphery of the pulley 54 also extending through the wall of the intermediate tubular section 26. The cable 50 then extends diametrically across the intermediate tubular member 26 and passes over a pulley 56 which is diametrically opposed and aligned with the pulley 54 and also is longitudinally aligned with the pulley 46 so that cable 50 extends straight across and diametrically across the lower end portion of the intermediate tubular member 26.

The cable 50 then extends downwardly along the outer surface of the lower tubular member 24 and is anchored at a point adjacent the bottom thereof at anchor point 58. As indicated, when the winch drum 37 is actuated to wind the cable 40 thereon thus lifting the intermediate section 26 upwardly, the winch drum unwinds cable 50 therefrom so that the pulleys 56 and 54 may move upwardly along with the pulleys 44 and 46 and the lower end portion of the intermediate section 26. Then, when the motor 38 is reversed, the drum 37 on the winch 36 will wind cable 50 onto the drum and at the same time unwind cable 40 therefrom at the same rate. Thus, a positive lifting and power retraction is provided inasmuch as the rate of movement of the cables 40 and 50 with respect to the winch drum is the same. The anchor points may be provided with adjustments or other adjustments may be provided in order to initially adjust the effective length of the cables to properly tension the cables for operating in the manner described. The pulleys are mounted on suitable brackets externally of the lower section with those pulleys mounted on the intermediate section being journalled on transversely extending axle pins or shafts 58 in order to properly journal the pulleys in their desired relationship to the intermediate tubular section 26.

A coaxial cable 60 is anchored at the center of the lower portion of intermediate tubular section 26 at anchor point 62 and passes outwardly through openings 64 at diametrically opposed and aligned points in the wall of the intermediate tubular section 26 just above the pulleys 44 and 46 with the coaxial cable then extending upwardly between the exterior of the tubular section 26 and the lowet tubular section 24 and passes over diametrically opposed and aligned pulleys 66 and 67 mounted on suitable brackets and associated with openings in the peripheral wall of the tubular member 24 so that the coaxial cable can pass outwardly and over the pulleys 66 and 67 and then downwardly in a position outwardly of the tubular member 24 for connection with multi-sheave pulleys 68 and 70 which are located generally in alignment with but below the pulleys 66 and 67. The pulleys 68 and 70 are in alignment with similar pulleys 71 and 72 which are anchored adjacent the lower end of the lower tubular member 24 at adjustable anchor points 74 and 76 respectively. Multiple coaxial cable assemblies interconnect the multi-sheave pulleys 66 and 67 at the upper ends and 70 and 72 at the lower ends of the lower tubular member 24 and each of the coaxial cables extend from the pulley assemblies 68 and 70 upwardly over pulleys 78 and 80, 81 and 82 which correspond with the pulleys 68 and 70 and then downwardly between adjacent tubular sections such as the sections 26 and 28 and through the respective tubular members 28 and 30 and anchored thereto in a repetitive manner with their being as many coaxial cables as there are stages thus sychronizing the antenna base wire with the top end of the final stage. An additional function of the coaxial cable assembly in conjunction with the retracting cable is to power down the tower in the retracting process.

A second stage extension cable 90 extends diametrically of the bottom portion of the second intermediate tubular member 28 or the second stage extension and extends diametrically outwardly of the wall of the second stage tubular member 28 and extends upwardly between the tubular members 26 and 28 and over the pulleys 78 and 80 along with the coaxial cables and then extend downwardly and are anchored to the brackets for the pulleys 66 and 67 at the upper end of the tubular member 24 and being anchored thereto as at 92. Thus, as the first stage tubular member 26 is lifted by the cable 40, the end of the cable 90 being anchored at point 92 to the bracket for pulleys 66 and 67 will effectively lift the second stage tubular member 28 upwardly in relation to the first stage tubular member 26 as it is extended.

Likewise, the lift cable 94 for the third stage tubular member 30 is anchored to the brackets for the pulleys 78 and 80, respectively, at points 96 and extends over the pulleys 81 and 82 and downwardly between the second stage tubular member 28 and third stage tubular member 30 and diametrically across the lower end portion of the third stage tubular member 30. This structure is repeated for each of the stages depending upon the number of stages involved and since there is no relative linear movement of the lifting or extending cables 90 and 94, they are not provided with pulleys where they pass through the lower end of the respective tubular members but do pass over pulleys at their upper ends where relative linear movement occurs between the cables and the upper end of the tubular member. The number of lifting or extending cables corresponds with the number of stages of the mast which are used and the number of coaxial cables also corresponds with the number of stages with the coaxial cable having as many cables as there are stages with the antenna base wire connecting with the top end of the final stage and the lower end of the coaxial cable being connected to radios, computers and the like.

Any suitable bracing, guy wires and the like may be provided and connected to the antenna mast in any suitable manner for retaining it in vertical position. The structure of the antenna mast enables quick and easily extension of the mast by operating the winch and at the same time the coaxial cable is extended at the same rate of movement as the uppermost stage of the antenna mast and the sections of the antenna mast are power lowered by the retraction cable and the coaxial cables.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is as new is as follows:

1. An extendible and retractable antenna mast comprising a plurality of tubular, telescopic sections including a vertically stationary base tubular section and a plurality of upper tubular sections, a lift cable having one end anchored to the base section adjacent the upper end thereof and extending diametrically of the lower end portion of a first upper tubular section and extending upwardly toward the upper end of the base section in diametrically opposed relation to the point at which the lifting cable is anchored and being connected to a winch means for raising the first upper tubular section in relation to the base section, a retracting cable independent from the lifting cable having one end anchored to the base section adjacent the lower end thereof and extending transversely of the lower end portion of the first upper section and connected to the winch means for retracting the first upper tubular section, said winch means being reversible and winding the lifting cable thereon at the same rate as the retracting cable is unwound therefrom in one direction of rotation and winding the retracting cable at the same rate as unwinding the lifting cable in the other direction of rotation to provide a positive lifting and retracting of the first upper tubular section in relation to the base section, means interconnecting the first upper tubular section to the next adjacent tubular section to simultaneously extend the next adjacent tubular section upwardly when the first upper tubular section is moved vertically upwardly in relation to the base section, and coaxial cable means connected to the first upper tubular section and each additional upper tubular section and connected to a pulley assembly enabling the coaxial cable means to move upwardly and downwardly at the same rate as each upper tubular section, said retracting cable extending downwardly from the winch means and under a pulley located externally of the base section adjacent the lower end thereof with the retracting cable extending inwardly through the base section and diametrically of the lower end portion of the first upper tubular section and then downwardly along the outer surface of the base section and being anchored to the base section adjacent the lower end thereof so that downward force can be exerted on the first upper section when the first upper section has been extended upwardly so that the retracting cable is moved upwardly therewith as it is unwound from the winch means.

2. The structure as defined in claim 1 wherein said winch means is mounted externally of the base tubular section intermediate the ends thereof with the lifting cable extending upwardly therefrom and over a pulley spaced diametrically from the anchor point of the lifting cable to the base section at substantially the same vertical elevation with the lifting cable extending downwardly between the base section and first upper section and diametrically across the lower end portion of the first upper section and then upwardly between the interior of the base section and the exterior of the first upper tubular section to the anchor point.

3. The structure as defined in claim 2 wherein said first upper tubular section includes a pair of diametrically aligned and spaced pulleys in the lower end portion thereof receiving the diametrically extending portion of the lifting cable to facilitate linear movement of the lifting cable in relation to the first upper tubular section.

4. The structure as defined in claim 3 wherein said first upper section includes a pair of diametrically spaced and aligned pulleys over which the retracting cable is entrained thereby facilitating linear movement of the retracting cable in relation to the upper tubular section, said pulleys for the retracting cable being located below and in alignment with the pulleys for the lifting cable.

5. The structure as defined in claim 4 wherein said means moving the next adjacent upper section upwardly includes a pulley mounted at the upper end of the next adjacent upper section, a lifting cable passing over the pulley and extending downwardly and having one end anchored to the upper end portion of the base section, said cable also extending downwardly between the first upper section and the next adjacent upper section and connected to the lower end portion thereof so that when the pulley at the upper end of the first upper section is moved upwardly, it will move the lifting cable for the next adjacent upper section in a linear manner to elevate simultaneously the next adjacent upper section in relation to the first upper section, said means for lifting the next adjacent upper section being repeated for each stage of the antenna mast.

6. The structure as defined in claim 5 wherein said coaxial cable means includes a plurality of coaxial cables associated with each of the upper sections of the antenna mast, each coaxial cable including a portion anchored to the lower end of each upper section with the coaxial cable associated with the first upper section passing over a pulley at the upper end of the base section and extending downwardly and being connected with a movable pulley assembly including upper and lower pulleys with the lower pulley anchored to a point adjacent the bottom of the base section and a plurality of coaxial cables mounted thereon with the upper pulley being movable to move the coaxial cable connected to the lower end portion of the respective upper tubular sections upwardly and downwardly when the first upper tubular section is moved upwardly by the lifting cable and moved downwardly by the retracting cable.

* * * * *